United States Patent [19]

Hamu

[11] Patent Number: 4,694,746

[45] Date of Patent: Sep. 22, 1987

[54] SILKSCREEN FRAME MOUNTING ASSEMBLY FOR PRESS

[76] Inventor: Kaino J. Hamu, 25142 Wandering La., El Toro, Calif. 92630

[21] Appl. No.: 889,582

[22] Filed: Jul. 22, 1986

Related U.S. Application Data

[63] Continuation of Ser. No. 657,832, Oct. 5, 1984, abandoned.

[51] Int. Cl.[4] ..... B41F 15/36

[52] U.S. Cl. ..... 101/124; 101/128.1

[58] Field of Search ..... 101/128.1, 127.1, 128, 101/121, 123, 114, 124

[56] References Cited

U.S. PATENT DOCUMENTS

| | | | |
|---|---|---|---|
| 3,166,011 | 1/1965 | Landesman | 101/123 |
| 3,263,603 | 8/1966 | Fuchs | 101/123 |
| 3,537,406 | 11/1970 | Ort | 101/123 X |
| 3,828,671 | 8/1974 | Fuchs | 101/123 |
| 4,054,091 | 10/1977 | Bradley | 101/123 |
| 4,073,232 | 2/1978 | Brewer | 101/128.1 X |
| 4,254,707 | 3/1981 | Lambert et al. | 101/123 |

FOREIGN PATENT DOCUMENTS

| | | | |
|---|---|---|---|
| 962889 | 6/1950 | France | 101/123 |
| 1055370 | 3/1960 | France | 101/123 |

*Primary Examiner*—J. Reed Fisher
*Attorney, Agent, or Firm*—Boniard Brown

[57] ABSTRACT

An improved mounting assembly for removably mounting a stencil screen stretch frame in a so-called silk-screen printing press in a manner which facilitates removal and replacement of the screen frame, reduces the frame cost, and renders the frame easier to handle and stack. The mounting assembly includes mounting means to be secured to the frame mounting portion of the printing press and readily accessible, easily releasible fastening means releasibly securing the screen frame to the mounting means. In one described presently best mode embodiment of the invention, which is designed primarily for a cylinder screen printing press having a carriage for mounting the screen frame, the mounting means of the screen frame mounting assembly comprises a carrier frame having mounting brackets for attachment to the printing press carriage and adapted to removably receive and support the screen frame, and readily accessible, easily releasible fastening means on the carrier frame engagable with the screen frame for releasably securing the latter in the carrier frame. A secondly described presently best mode embodiment comprises mounting brackets, and readily accessible easily releasible fastening means securing the brackets to the screen frame and to the printing press carriage.

7 Claims, 8 Drawing Figures

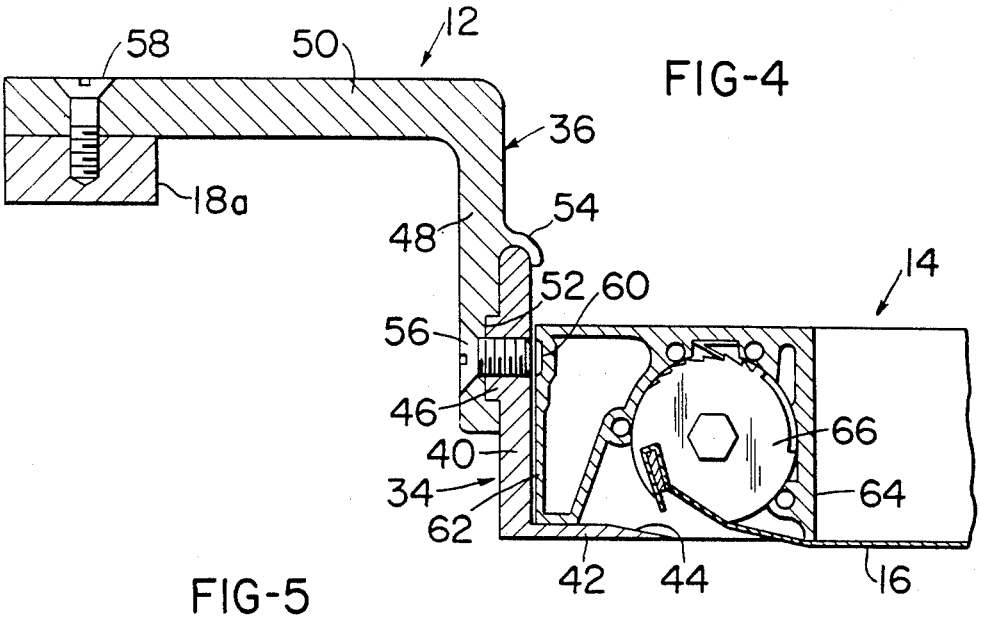
FIG-4
FIG-5
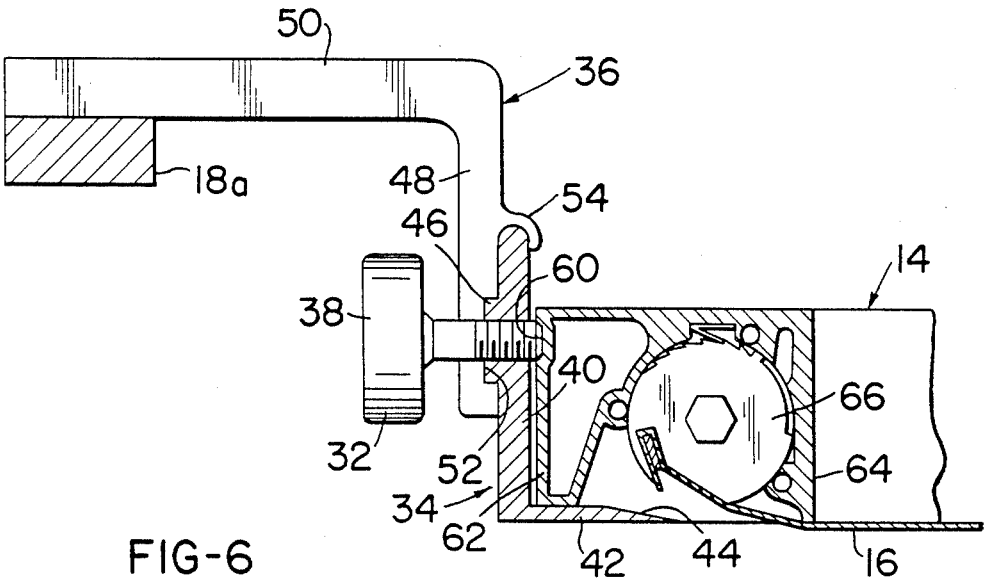
FIG-6
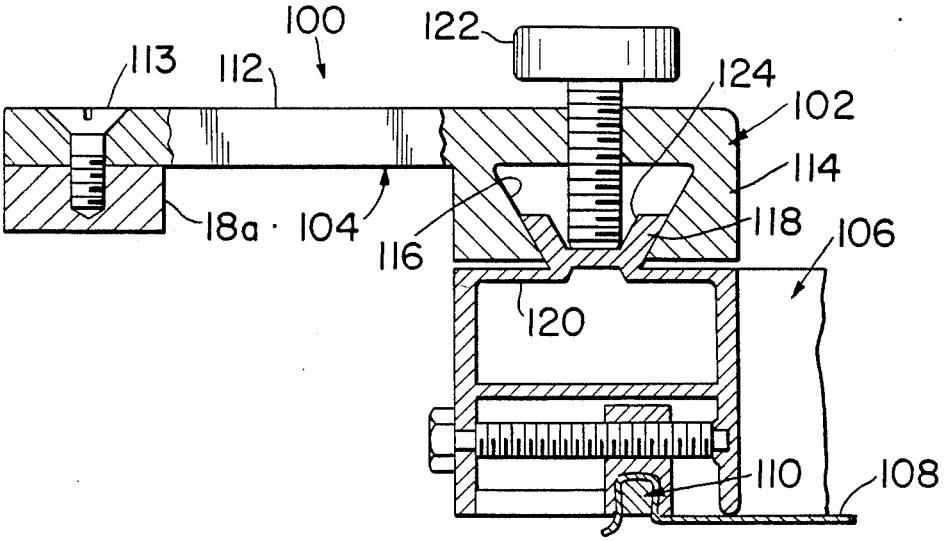

SILKSCREEN FRAME MOUNTING ASSEMBLY FOR PRESS

This is a continuation of copending application Ser. No. 657,832 filed on Oct. 5, 1984 now abandoned.

BACKGROUND OF THE INVENTION

1. Field of the Invention

This invention relates generally to the so-called silkscreen printing art and more particularly to an improved mounting assembly for removably mounting a stencil screen stretch frame in a silkscreen printing press.

2. Discussion of the Prior Art

The prior art of stencil screen printing, often referred to as silkscreen printing, is well known and widely used for a wide variety of printing applications. Briefly stated, silkscreen printing, or stencil screen printing as it will be referred to in this disclosure, is performed with the aid of a stencil screen to which a stencil pattern is applied in any convenient way. Silk cloth was originally used as the stencil screen and hence the name silkscreen printing. A variety of other stencil screen materials have been developed, however, and are used today although the name silkscreen printing persists.

In the stencil screen printing process, the stencil screen is stretched across the open side of a screen stretch frame and placed with one side of the screen in contact with the article to be printed. A suitable printing ink, which may be a true ink, paint, dye, or other printing medium, is spread across the opposite side of the screen. This ink is forced through the screen onto the article to be printed by means of a squeegee to reproduce on the article the stencil pattern on the stencil screen. Multicolor screen prints may be produced by performing a number of successive stencil screen printing operations with different color printing inks.

Commercial stencil screen printing is performed on a stencil screen printing press in which the various printing operations occur automatically or semi-automatically to permit high-volume production. One such stencil screen printing press is a cylinder screen printing press. The present invention will be described in relation to such a cylinder screen printing press although it will become apparent as the description proceeds that the invention may be adapted to other types of screen printing presses.

Simply stated, a cylinder screen printing press has a carriage support for mounting a stencil screen stretch frame containing a stencil screen and means for reciprocating the screen frame and its stencil screen edgewise in the plane of the screen through a printing stroke in one direction and a return stroke in the opposite direction. Below the carriage is a rotatable cylinder which is substantially tangent to the plane of the stencil screen within a zone of tangency which is referred to herein places as a printing zone. The cylinder rotates in one direction in synchronism with edgewise movement of the stencil screen and screen frame through their printing stroke so that the surface of the cylinder and the stencil screen move in unison in the same direction through the zone of tangency, i.e., the printing zone, during each printing stroke of the stencil screen.

Sheets to be printed are fed in succession to the cylinder by an infeed mechanism. Each sheet is held to the cylinder by vacuum or other means and rotates with the cylinder through the printing zone in unison with movement with the stencil screen through its printing stroke.

During operation of the cylinder screen printing press, ink is applied to the side of the stencil screen opposite the cylinder during each return stroke of the screen and its frame. During the following printing stroke of the stencil screen and its frame, a squeegee engages the screen approximately along the printing zone and forces the ink through the screen onto the underlying sheet which is currently moving with the cylinder through the printing zone to reproduce on the sheet the stencil pattern on the stencil screen. An outfeed mechanism strips the printed sheet from the cylinder and feeds the sheet from the machine.

The existing cylinder screen printing presses have one deficiency which this invention overcomes. This deficiency resides in the manner of mounting the stencil screen stretch frame in the press. In the existing cylinder screen presses, the screen frame is mounted on the reciprocating frame carriage by means of mounting brackets which are welded or otherwise permanently and rigidly attached to the screen frame and are bolted to the carriage. This method of mounting the screen frame in a cylinder screen printing press has several disadvantages.

First, the removal and replacement of a screen frame requires unbolting and bolting of the several frame mounting brackets from and to the printing press carriage. Secondly, the overall cost of the screen frame and its welded mounting brackets is relatively high. Thirdly, the mounting brackets, projecting as they do from the screen frame, render the frame difficult to handle and stack. Moreover, these mounting brackets often incur damage during handling and stacking.

SUMMARY OF THE INVENTION

According to one of its more limited aspects, the present invention provides an improved mounting assembly for mounting a stencil screen stretch frame in a cylinder screen printing press of the character described and which overcomes the above-noted and other disadvantages of the existing frame mounting arrangements. To this end, the improved screen frame mounting assembly includes mounting means for attachment to the reciprocating carriage of the cylinder screen press, and readily accessible, easily releasible fastening means for securing the screen frame to the mounting means. Thus, the screen frame may be quickly and easily removed from and replaced in the printing press. Also, the screen frame, when not in use, is devoid of projecting brackets and the like and is thus easier to handle and stack, and is cheaper to fabricate, than the existing screen frames with their welded mounting brackets.

Two currently best mode embodiments of the invention are disclosed. In one embodiment, the screen frame mounting means comprises a carrier frame having attachment means, such as mounting brackets, for attaching the carrier frame to the reciprocating carriage on the cylinder screen printing press. This carrier frame removably supports the stencil screen frame and carries readily accessible, easily releasible fastening means engagable with the screen frame for releasibly securing the latter in the carrier frame. Thus, all that is necessary to remove the screen frame from the printing press is to release the fastening means and lift the screen frame from the carrier frame. The screen frame is easily installed in the carrier frame by reversing this procedure.

In the second described best mode embodiment of the invention, the screen frame mounting means comprise attachment means, such as mounting brackets, releasibly engaging the screen frame, and readily accessible, easily releasible fastening means securing the brackets to the frame and to the reciprocating carriage of the cylinder screen printing press. The screen frame is removable from the printing press by releasing the fastening means that secure the mounting brackets to the printing press carriage, removing the screen frame and its mounting brackets from the press, releasing the fastening means that secure the brackets to the screen frame, and then removing the brackets from the frame. The screen frame is installed in the printing press by reversing this procedure.

While the invention is described in relation to a cylinder screen printing press, it will become apparent as the description proceeds that the stencil screen mounting assembly of the invention may be adapted to other types of printing presses. Accordingly, the invention should not be thought of as limited in application to a cylinder screen printing press.

BRIEF DESCRIPTION OF THE DRAWINGS

FIG. 4 is a further enlarged section taken on line 4—4 in FIG. 3;

FIG. 5 is a further enlarged section taken on line 5—5 in FIG. 3; and FIG. 6 is a fragmentary section through a modified screen frame mounting assembly according to the invention.

DESCRIPTION OF THE PREFERRED EMBODIMENTS

Figure 1:
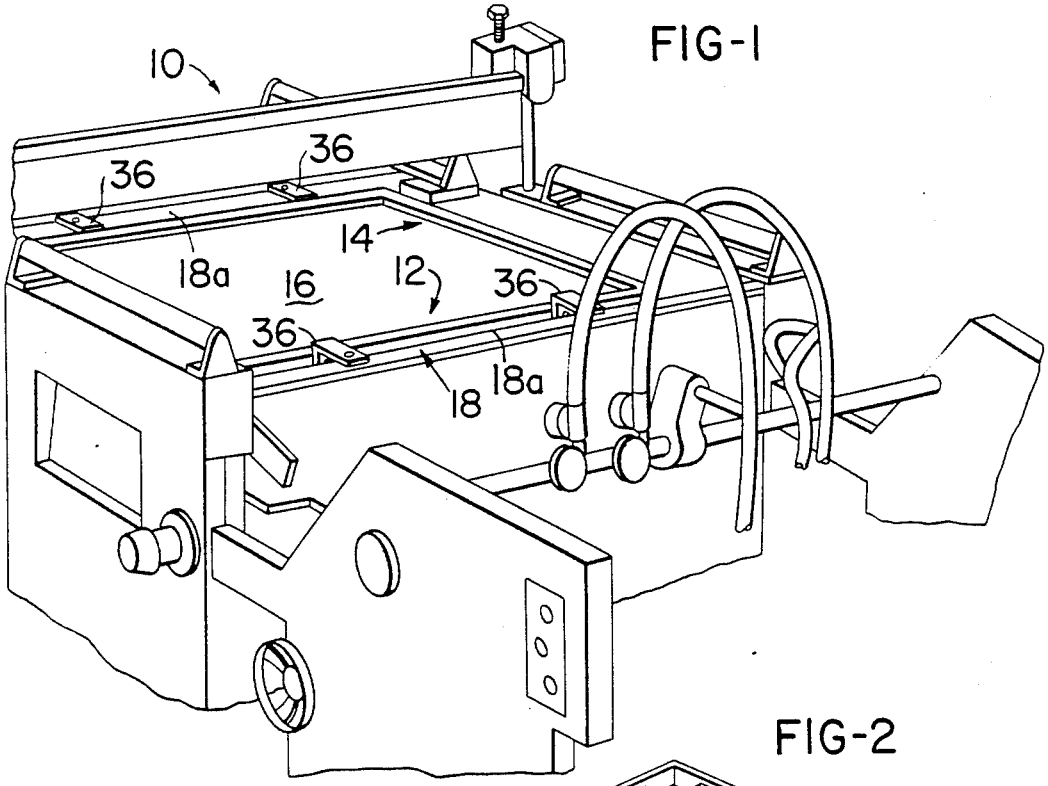
FIG. 1 is a fragmentary perspective view of a conventional cylinder screen printing press equipped with an improved stencil screen mounting assembly according to the invention.
Figure 2:
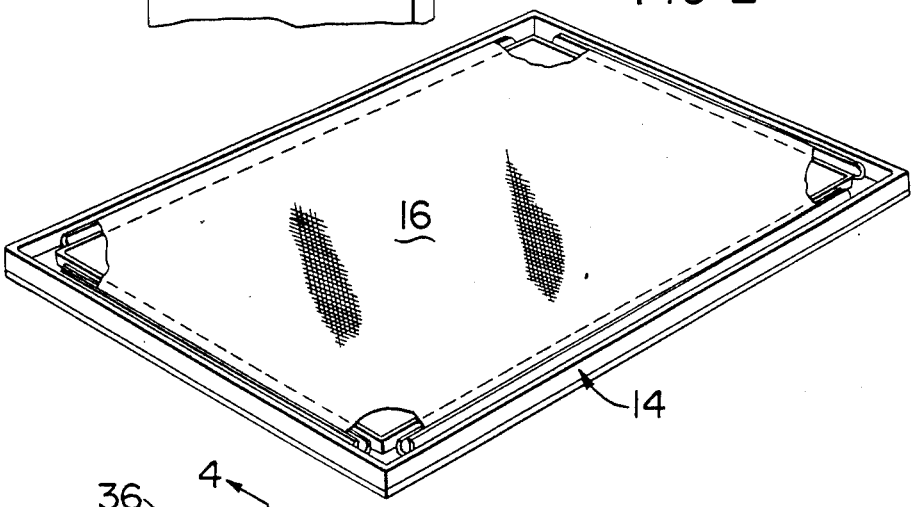
FIG. 2 is an enlarged perspective view of a stencil screen stretch frame containing a stencil screen to be used in the cylinder screen press of FIG. 1.
Figure 3:
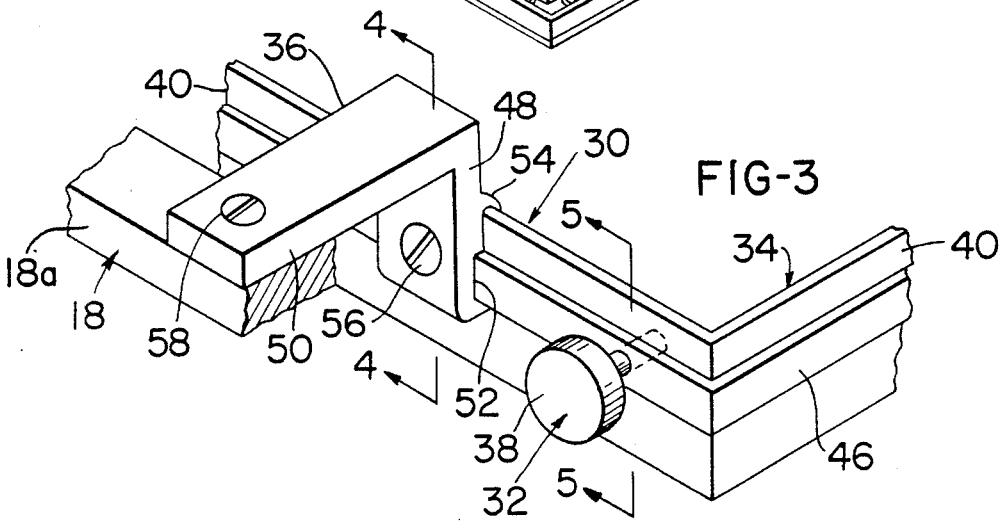
FIG. 3 is an enlarged fragmentary perspective view of the screen frame mounting assembly in FIGS. 1, 1A, and 1B.
Figure 1A:
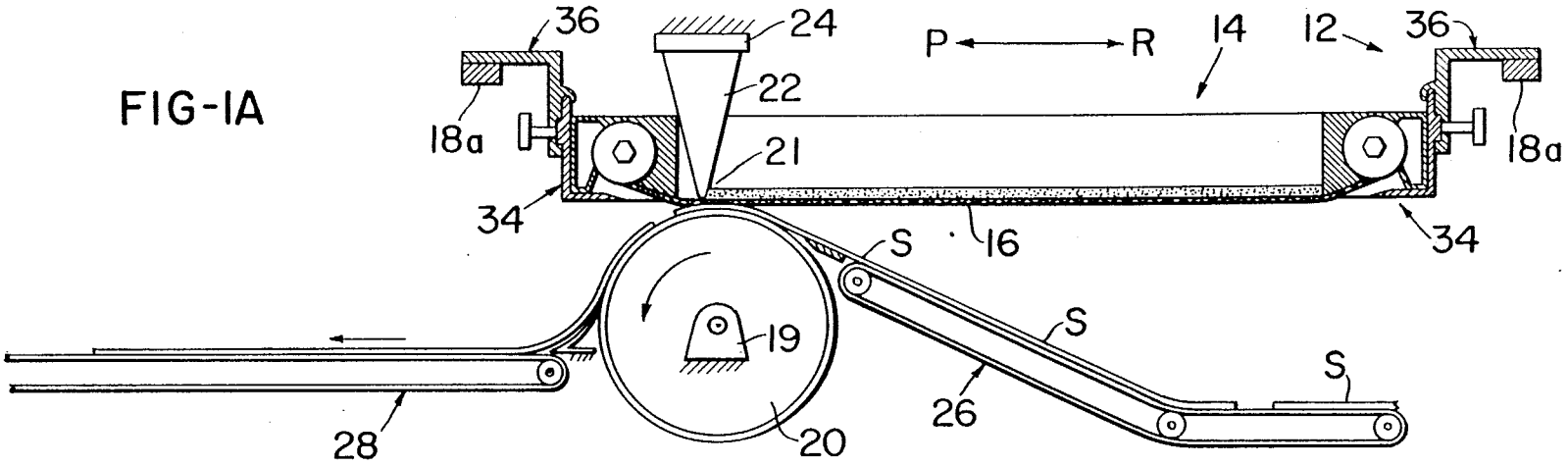
FIG. 1A is a semi-diagrammatic vertical section of certain portions of the cylinder screen printing press in FIG. 1 including the improved screen frame mounting assembly.
Figure 1B:
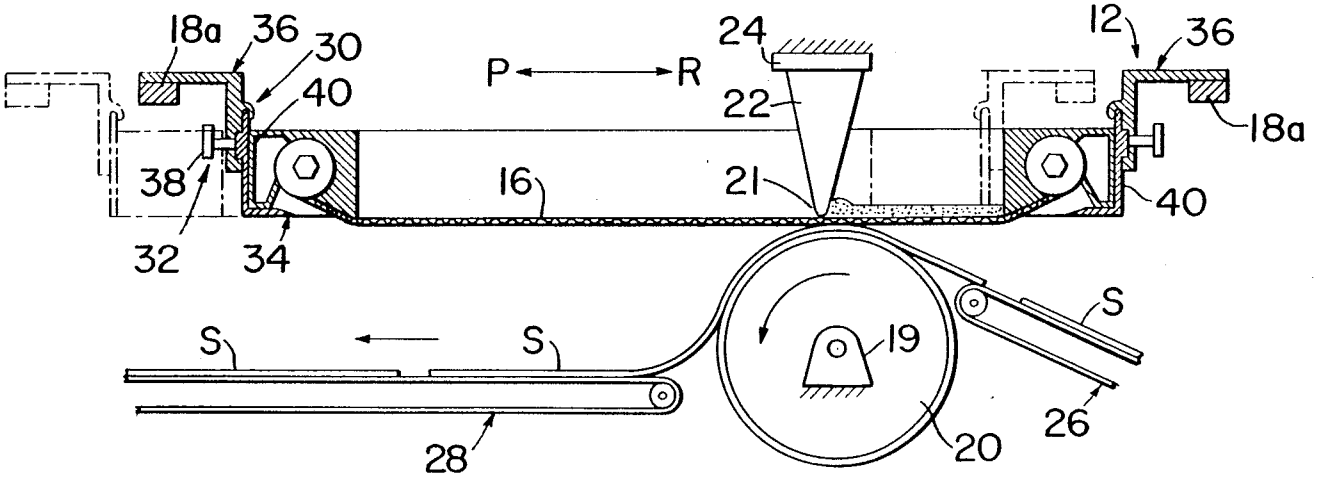
FIG. 1B is a view similar to 1A showing the machine in another position of operation.

Turning now to these drawings, and first to FIGS. 1, 1A, and 1B, there is illustrated a cylinder screen printing press 10 in which is removably mounted, by a mounting assembly 12 according to the invention, a stencil screen stretch frame 14 containing a stencil screen 16 bearing a stencil pattern (not shown) to be printed. Except for the screen frame mounting assembly 12, the printing press 10 is conventional. The particular printing press shown, for example, is a Sakurai cylinder screen printing press SC series model 2028 marketed by the Dorn Co. Accordingly, it is unnecessary to describe or illustrate the printing press in elaborate detail.

Suffice it to say that the cylinder screen printing press 10 has a screen frame support in the form of a carriage 18 on which the screen frame 14 is removably mounted in a substantially horizontal plane between two spaced support members 18*a* of the carriage 18 by the frame mounting assembly 12 of the invention. Carriage 18 supports the frame 14 for edgewise reciprocating movement in its horizontal plane in the direction of the arrows P, R in FIGS. 1A and 1B, the carriage and frame are movable in the direction P through a printing stroke and in the opposite direction R through a return stroke. FIG. 1A illustrates the carriage and screen frame at their initial position at the start of the printing stroke. FIG. 1B illustrates the carriage and screen frame in the course of the printing stroke.

Rotatably mounted by bearing supports 19 below the screen frame 14 and carriage 18 is a cylinder 20. The cylinder turns on a horizontal axis parallel to the plane of the stencil screen 16 and extending transverse to the horizontal directional line P, R of the frame and carriage. The cylinder surface is substantially tangent to the plane of the stencil screen 16 along a zone 21 of tangency which is herein referred to in places as a printing zone. The cylinder 20 rotates but does not move laterally.

Mounted on the printing press 10 above the screen frame 14 is a resiliently flexible squeegee 22. The squeegee is disposed over and generally parallel to the axis of the cylinder 20. The upper edge of the squeegee is firmly attached to an elevated support 24 on the printing press. The low or tip edge of the squeegee presses against the stencil screen 16 along or close to the printing zone 21, i.e., the zone of tangency of the screen with the cylinder 20. The squeegee yieldably presses the stencil screen against the cylinder along this printing zone.

During operation of the cylinder screen printing press 10, the screen frame 14 and carriage 18 are reciprocated, by means not shown, through successive printing cycles each involving movement of the frame and carriage from their initial position of FIG. 1A through a printing stroke in the direction P and thereafter through a return stroke in the direction R back to their initial position. The cylinder 20 is rotatably driven, by means not shown, in such a way that the stencil screen 16 and the surface of the cylinder move in unison through the printing zone 21 during each printing stroke of the screen.

The printing press 10 has infeed means 26 for feeding sheets S to be printed in succession to the printing zone 21, between stencil screen 16 and the cylinder 20, in timed relation to the reciprocating motion of the screen frame 14 and printing press carriage 18. This sheet infeed is timed so that each sheet S enters the printing zone 21 approximately concurrently with commencement of a printing stroke of the screen frame 14 and its stencil screen 16. Embodied in the cylinder 20 are vacuum means (not shown) which cause each arriving sheet to adhere and conform to the cylinder surface, whereby each sheet is moved edgewise through the printing zone 21 in unison with movement of the stencil screen 16 through this zone. The printing press 10 also has sheet outfeed means 28 for extracting each sheet S from the cylinder and feeding the sheet from the press.

From the above description, it will be understood that the sheets S undergo edgewise movement in succession through the printing zone 21 in unison with periodic edgewise movement of the stencil screen 16 through the zone during its successive printing strokes. The squeegee 22 presses the stencil screen 16 against each sheet during its movement through the printing zone. The cylinder screen printing press 10 also includes means (not shown) for periodically applying ink to the top side of the stencil screen 16 in such a way that during each printing stroke of the screen, the squeegee 22 forces the ink through the screen along the printing zone 21 onto the underlying sheet S currently moving through the printing zone on the cylinder 20. The stencil pattern on the stencil screen is thus printed on each sheet S as it moves through the printing zone 21.

As thus far described, the cylinder screen printing press 10 is conventional except for the stencil screen frame mounting assembly 12. In the past, the screen frame 14 was attached to the printing press carriage 18 by brackets which were welded or otherwise permanently joined to the frame and bolted to the carriage. This screen frame mounting arrangement has the drawbacks mentioned earlier, namely difficulty of frame removal and replacement, high frame cost, and difficulty of frame handling and stacking.

The stencil frame mounting assembly 12 of this invention overcomes these defects of the existing frame mounting arrangements. Generally stated, the stencil frame mounting assembly 12 of the invention comprises stencil frame mounting means 30 and readily accessible, easily releasible fastening means 32 for releasibly securing the stencil screen 14 to the mounting means 30. Removal of the screen frame 14 and its stencil screen 16 is quickly and easily accomplished by releasing the fastening means 32 and removing the frame. Replacement of the frame is just as easily accomplished.

The particular stencil screen frame mounting assembly 12 illustrated in FIGS. 1 through 5 and FIGS. 1A and 1B will now be described in more detail. The stencil frame attachment means, in this case mounting means 30 of the mounting assembly 12 comprises a carrier frame 34 and mounting brackets 36, securing the carrier frame to the printing press carriage 18. The readily accessible, easily releasible fastening means 32 comprise setscrews with enlarged knurled heads 38. The carrier frame 34 has generally vertical sidewalls 40 and bottom horizontal flanges 42 projecting inwardly from the bottom edges of the sidewalls. The carrier frame is essentially an open rectangular frame with a top opening bounded by the frame sidewalls 40 and a bottom opening bounded by the frame flanges 42. The inner edges of the flanges are tapered at 44. On the outer side of the frame sidewalls 40 are projecting ribs 46 extending circumferentially about the frame between the upper and lower edges of the sidewalls.

The carrier frame mounting brackets 36 are located at each end of the carrier frame 34 relative to the direction of its movement with the printing press carriage 18. Each bracket has a vertical arm 48 and a horizontal arm 50. The vertical arm 48 of each brackets seats against the outer side of the adjacent carrier frame sidewall 40 and has a transverse groove 52 receiving the rib 46 on the frame wall. Above the groove 52 is a shoulder 54 which fits over and seats on the upper edge of the adjacent carrier frame sidewall 40. Each mounting bracket 36 is secured to the adjacent carrier frame sidewall 40 by a screw 56. The horizontal arm 50 of each mounting bracket 36 seats on and is secured by a screw 58 to the printing press carriage 18.

Carrier frame 34 is sized to somewhat loosely receive the stencil screen frame 14, as shown in FIGS. 4 and 5. The screen frame 14 is placed in and removed from the carrier frame through the open topside of the carrier frame. When positioned in the carrier frame, the screen frame 14 seats on the bottom of flange 42 of the carrier frame. The screen frame fastening screws 32 are threaded in the sidewalls 40 of the carrier frame 34 and seat in dimples or grooves 60 in the outer sidewall 62 of the screen frame 14 to firmly secure the screen frame in the carrier frame.

From the above description, it is evident that the screen frame 14 is supported in the carrier frame 34 for edgewise movement with the printing press carriage 18, as explained earlier. The screen frame is readily and quickly removable from and replaceable in the carrier frame by simply loosening and tightening the screen frame fastening screws 32.

The present stencil screen frame mounting assembly 12 may be utilized to mount different types of stencil screen frames in the cylinder screen frame printing press 10. The particular screen frame 14 shown is essentially like that described in my prior U.S. Pat. No. 4,409,749. The stencil screen 16 extends across the open bottom side of the screen frame and across the bottom edges of the inner frame sidewalls 64 and is secured along its edges to screen frame tensioning means 66 between the frame walls 62, 64. As shown in FIGS. 4 and 5, the outer screen frame sidewall 62 rests on the carrier frame flanges 42 to support the screen frame in the carrier frame. The inner screen frame walls 64 are located inwardly of the carrier frame flanges 42 and project slightly below the outer screen frame wall 62 so that the bottom edges of the inner screen frame walls 64 are substantially flush with the bottom surfaces of the carrier frame flanges 42. The stencil screen frame 16 is thus supported in a plane substantially flush with or just slightly below the bottom side of the carrier frame.

From the foregoing description, it is apparent that the invention provides an improved mounting assembly for removably supporting a stencil screen frame in a cylinder screen printing press. The mounting assembly is so constructed and arranged that when the screen frame 14 is mounted in the printing press 10, the stencil screen 16 will be disposed in the proper plane of approximate tangency to the cylinder 20 to enable the stencil screen printing action described earlier to occur as sheets S are fed through the printing zone 21.

FIG. 6 illustrates a modified printing screen mounting assembly 100 according to the invention. In this case, the screen frame mounting means 102 of the mounting assembly includes mounting brackets 104 (only one shown) located at the ends of the screen frame 106. The illustrated screen frame 106 is similar to that described in my prior U.S. Pat. No. 3,962,805 and supports a stencil screen 108 extending across the bottom side of the frame. The screen frame includes screen tensioning means 110 like those in my prior patent.

Each mounting bracket 104 has attachment means in the form of a horizontal arm 112 secured by a screw 113 to the carriage 18 of the cylinder screen printing press. At the underside of the outer end of each bracket arm is a depending boss 114 containing an undercut beveled groove 116 extending transverse to the arm and opening through the bottom side of the boss. Groove 116 slidably receives a beveled and undercut tongue or rib 118 on the top wall 120 of the screen frame 106.

The screen frame mounting assembly 100 includes a readily accessible, easily releasible fastening means or screw 122 in each bracket 104. This screw is vertically threaded in the outer end of the bracket arm 112 into the bracket groove 116 and engages in a recess 124 in the topside of the screen frame rib 118 to secure the bracket to the screen frame 106.

In this modified screen frame mounting assembly 100, removal of the screen frame 106 from the printing press 10 is accomplished by removing the screws 113 to release the mounting brackets 104 from the printing press carriage 18, removing the screen frame 106 with the mounting brackets 104 attached to the frame, releasing the frame fastening screws 122, and sliding the brackets from the frame, edgewise of the frame ribs 118. Replacement of the screen frame is accomplished by reversing this procedure.

Although the invention has been described in connection with a cylinder screen printing press, it will now be evident that the screen frame mounting assembly of the invention may be adapted to other types of printing presses.

The inventor claims:

1. A mounting assembly for removably mounting a stencil screen frame on the screen frame support of a stencil screen printing press between spaced members of the frame support, comprising:

an open rectangular carrier frame to be positioned between said support members of said printing press for receiving said screen frame through one side of the carrier frame, said carrier frame having sidewalls along the edges of the carrier frame substantially normal to the plane of the carrier frame and flanges projecting inwardly from said sidewalls along the sidewall edges at the opposite side of said carrier frame and disposed in a common plane generally parallel to said plane of the carrier frame, said opposite side of said carrier frame having an opening bounded circumferentially by said flanges, said carrier frame being adapted to receive said screen frame in a position wherein said screen frame rests on said flanges, screws threaded in said carrier frame sidewalls with their axes substantially parallel to said plane of the carrier frame for engaging the edges of a screen frame positioned in the carrier frame to releasibly secure the screen frame in the carrier frame, and mounting brackets rigidly joined to two opposite side walls of said carrier frame for mounting said carrier frame on said screen frame support of the printing press, said mounting brackets including arms extending outwardly from said opposite sidewalls in opposite edgewise directions of said carrier frame and in a common plane substantially parallel to said plane of said carrier frame flanges and offset from the latter plane toward said one side of said carrier frame for engagement over said screen frame support members of said printing press.

2. In combination:

a stencil screen printing press including a screen frame support having spaced support members, a mounting assembly for removably mounting a stencil screen frame on said screen frame support between said support members, said mounting assembly comprising an open rectangular carrier frame having sidewalls along the edges of the carrier frame substantially normal to the plane of the carrier frame and flanges projecting inwardly from said sidewalls along the sidewall edges at the opposite side of said carrier frame and disposed in a common plane generally parallel to said plane of the carrier frame, said opposite side of said carrier frame having an opening bounded circumferentially by said flanges, said carrier frame being adapted to receive said screen frame in a position wherein said screen frame rests on said flanges, screws threaded in said carrier frame sidewalls with their axes substantially parallel to said plane of the carrier frame for engaging the edges of a screen frame positioned in the carrier frame to releasibly secure the screen frame in the carrier frame, and means mounting said carrier frame on said screen frame support of the printing comprising mounting brackets rigidly joined to two opposite sidewalls of said carrier frame including arms extending outwardly from said opposite sidewalls and over said support member in a common plane substantially parallel to said plane of said carrier frame flanges and offset from the latter plane toward one side of said carrier frame, and means for securing said bracket arms to said support members.

3. In combination:

a stencil screen printing press including a screen frame support, a mounting assembly for removably mounting a stencil screen frame on said screen frame support including mounting means attached to said screen frame support for receiving a screen frame, and readily accessible, easily releasible fastening means for releasibly securing a stencil screen frame to said mounting means, said mounting means comprising a carrier frame for removably recieving said screen frame, and attachment means attaching said carrier frame to said screen frame support, said fastening means being mounted on said carrier frame, said carrier frame being an open rectangular frame having sidewalls transverse to the plane of the carrier frame for confining the screen frame edgewise, and flanges projecting inwardly from said sidewalls generally parallel to said plane for supporting the screen frame in the carrier frame, said fastening means comprising fasteners threaded in said carrier frame sidewalls for engagement with the screen frame in the carrier frame, said attachment means comprising mounting brackets on said carrier frame, and means securing said mounting brackets to said screen frame support, said printing press being a cylinder screen printing press including a cylinder located at one side of said carrier frame with its axis generally parallel to the plane of said carrier frame, said carrier frame flanges being located along the edges of said carrier frame sidewalls adjacent said cylinder, whereby said carrier frame supports a stencil screen frame with its stencil screen in a plane substantially tangent to said cylinder, and said screen frame support comprising a carriage movable back and forth in the edgewise direction of said carrier frame transverse to said cylinder and parallel to the plane of the carrier frame.

4. A stencil screen frame and mounting assembly to be mounted on the screen frame support of a stencil screen printing bress between spaced support members of said screen frame support, comprising:

a rectangular screen frame having a stencil screen spanning one side of the screen frame, an open rectangular carrier frame to be positioned between said support members of said printing press of receiving said screen frame through one side of the carrier frame, said carrier frame having sidewalls along the edges of the carrier frame substantially normal to the plane of the carrier frame and flanges projecting inwardly from said sidewalls along the sidewall edges at the opposite side of said carrier frame and disposed in a common plane generally parallel to said plane of the carrier frame, said opposite side of said carrier frame having an opening bounded circumferentially by said flanges, said carrier frame receiving said screen frame in a position wherein said screen frame rests on said flanges with said stencil screen extending across said carrier frame side opening, screws threaded in said carrier frame sidewalls with their axes substantially parallel to said plane of the carrier frame and engaging said screen frame positioned in the carrier frame to releasibly secure the screen frame in the carrier frame, and mounting brackets rigidly joined to two opposite side walls of said carrier frame for mounting said carrier frame on said screen frame support of the printing press, said mounting brackets including arms extending outwardly from said opposite sidewalls in opposite edgewise directions of said carrier frame and in a common plane substantially parallel to said plane of said carrier frame flanges and offset from the latter plane toward said one side of said carrier frame for engagement over said screen frame support members of said printing press.

5. In combination:

a stencil screen printing press including a screen frame support having spaced support members, a mounting assembly for removably mounting a stencil screen frame on said screen frame support, said mounting assembly comprising an open rectangular carrier frame to be positioned between said support members, said carrier frame having sidewalls along the edges of the carrier frame substantially normal to the plane of the carrier frame and flanges projecting inwardly from said sidewalls along the sidewall edges at the opposite side of said carrier frame and disposed in a common plane generally parallel to said plane of the carrier frame, said opposite side of said carrier frame having an opening bounded circumferentially by said flanges, said carrier frame being adapted to receive said screen frame in a position wherein said screen frame rests on said flanges, screws threaded in said carrier frame sidewalls with their axes substantially parallel to said plane of the carrier frame for engaging the edges of a screen frame positioned in the carrier frame to releasibly secure the screen frame in the carrier frame, and mounting brackets rigidly joined to two opposite sidewalls of said carrier frame mounting said carrier frame on said screen frame support of the printing press, said mounting brackets including arms extending outwardly from said opposite sidewalls in opposite edgewise directions of said carrier frame and in a common plane substantially parallel to said plane of said carrier frame flanges and offset from the latter plane toward said one side of said carrier frame for engagement over said screen frame support members of said printing press.

6. The combination according to claim 2 wherein:

said printing press is a cylinder screen printing press including a cylinder located at said opposite side of said carrier frame with its axis generally parallel to the plane of said carrier frame, said carrier frame supports a stencil screen frame with its stencil screen in a plane substantially tangent to said cylinder, and said screen frame support comprises a carriage movable back and forth in the edgewise direction of said carrier frame transverse to said cylinder and parallel to the plane of said carrier frame.

7. The combination according to claim 5 wherein:

said printing press is a cylinder screen printing press including a cylinder located at said opposite side of said carrier frame with its axis generally parallel to the plane of said carrier frame, said carrier frame supports a stencil screen frame with its stencil screen in a plane substantially tangent to said cylinder, and said screen frame support comprises a carriage movable back and forth in the edgewise direction of said carrier frame transverse to said cylinder and parallel to the plane of said carrier frame.

* * * * *